US009123240B1

(12) United States Patent
Sikora et al.

(10) Patent No.: US 9,123,240 B1
(45) Date of Patent: Sep. 1, 2015

(54) SYSTEM AND METHOD FOR LASER EMITTER FOR TRAFFIC PREEMPTION

(71) Applicant: Tomar Electronics, Inc., Gilbert, AZ (US)

(72) Inventors: Scott T. Sikora, Gilbert, AZ (US); Bart Millikan, Gilbert, AZ (US); David G. Worthy, Gilbert, AZ (US)

(73) Assignee: Tomar Electronics, Inc., Gilbert, AZ (US)

( * ) Notice: Subject to any disclaimer, the term of this patent is extended or adjusted under 35 U.S.C. 154(b) by 134 days.

(21) Appl. No.: 13/968,192

(22) Filed: Aug. 15, 2013

(51) Int. Cl.
*G08G 1/00* (2006.01)
*G08G 1/07* (2006.01)
*G08G 1/087* (2006.01)

(52) U.S. Cl.
CPC . *G08G 1/07* (2013.01); *G08G 1/087* (2013.01)

(58) Field of Classification Search
CPC ..... G08G 1/00; G08G 1/095; G08G 1/07
See application file for complete search history.

(56) References Cited

U.S. PATENT DOCUMENTS

| | | | | |
|---|---|---|---|---|
| 6,707,391 | B1 * | 3/2004 | Monroe | 340/901 |
| 2011/0292673 | A1 * | 12/2011 | Aono et al. | 362/553 |
| 2014/0299897 | A1 * | 10/2014 | Zhang et al. | 257/88 |

* cited by examiner

*Primary Examiner* — Van Trieu
(74) *Attorney, Agent, or Firm* — Booth Udall Fuller, PLC

(57) ABSTRACT

A laser emitter for a traffic control preemption system, the laser emitter comprising a laser emitting diode or array configured to emit a laser beam, one or more optics coupled to the laser emitting diode and configured to shape the laser beam, and a control module configured to trigger emission of the laser beam at a predetermined frequency and for a predetermined duration in accordance with one or more requirements of the traffic control preemption system.

24 Claims, 7 Drawing Sheets

SYSTEM AND METHOD FOR LASER EMITTER FOR TRAFFIC PREEMPTION

BACKGROUND

1. Technical Field

Aspects of this document relate generally to traffic preemption systems.

2. Background Art

Traffic preemption systems are conventionally used to permit emergency and other vehicles to change a traffic light initially red at an intersection to green prior to their arrival. With the light in the vehicle's favor, the vehicle does not need to wait or to drive on the wrong side of the street to avoid stopped vehicles at the light. In addition, conventional traffic preemption systems have been used to aid public transportation vehicles, such as buses, to maintain headway relative to other vehicles during high traffic periods.

Currently, such systems rely on optical or infrared emitters within the vehicle preemption unit of the system to emit a signal that is detected by the systems detection unit, thereby leading to a change in a traffic signal based on the optical or infrared signal detected. Current infrared systems require sizeable emitting optics due to the source size to control the divergence of an infrared signal so that an appropriate beam width can be achieved for proper detection.

SUMMARY

Implementations of a laser emitter for a traffic control preemption system may comprise a laser emitting diode or array configured to emit a laser beam, one or more optics coupled to the laser emitting diode or array and configured to shape the laser beam, and a control module configured to trigger emission of the laser beam at a predetermined frequency and for a predetermined duration in accordance with one or more requirements of the traffic control preemption system.

Particular implementations may comprise one or more of the following aspects. The laser emitter may further comprise a collimating lens configured to narrow the laser beam when the laser beam passes through the collimating lens prior to passing through the one or more optics. The one or more optics may be a beam shaping diffuser. The one or more optics may be configured to spread the laser beam to a width that is recognized by the traffic control preemption system. The laser emitter may be configured to mount to a vehicle. The laser emitting diode or array may be configured to emit infrared radiation. The laser emitter may further comprise one or more light emitting diodes (LED's) configured to increase the distance or range of angles at which a beam is emitted from the laser emitter. The laser emitter may further comprise one or more light emitting diodes (LED's) wherein the control module is further configured to trigger the one or more LED's to emit light according to a flash pattern that is different than that of the laser emitting diode. The control module may be further configured to activate the one or more LED's independently of activation of the laser emitting diode. The control module may be further configured to trigger emission of the laser beam according to a flash code that designates a level of priority when received by a traffic control preemption unit configured to mount to a traffic light support. The laser emitter may further comprise an optical light source and a visible light filter. The visible light filter may be configured to be remotely activated such that only infrared radiation is emitted by the laser emitter when the visible light filter is active.

Implementations of a method of creating a laser emitter for traffic control preemption may comprise providing a laser emitting diode or array configured to emit a laser beam, coupling one or more optics to the laser emitting diode or array such that the one or more optics are configured to shape the laser beam, configuring a control module to trigger emission of the laser beam at a predetermined frequency and for a predetermined duration in accordance with one or more requirements of a traffic control preemption system, and coupling the control module to the laser emitting diode.

Particular implementations may comprise one or more of the following aspects. The method may further comprise coupling a collimating lens to the laser emitting diode such that the laser beam is narrowed when the laser beam passes through the collimating lens prior to passing through the one or more optics. The one or more optics may be a beam shaping diffuser. The method may further comprise configuring the one or more optics to spread the laser beam to a width that is recognized by the traffic control preemption system. The method may further comprise configuring the laser emitter to mount to a vehicle. The laser emitting diode or array may be configured to emit infrared radiation. The method may further comprise configuring one or more light emitting diodes (LED's) to increase a range of distance or angles at which a beam is emitted from the laser emitter and coupling the one or more LED's to the laser emitting diode. The method may further comprise coupling one or more light emitting diodes (LED's) with the laser emitting diode and further configuring the control module to trigger the one or more LED's to emit light according to a flash pattern that is different than that of the laser emitting diode. The method may further comprise configuring the control module to activate the one or more LED's independently of activation of the laser emitting diode. The method may further comprise configuring the control module to trigger emission of the laser beam according to a flash code that designates a level of priority when received by a traffic control preemption unit configured to mount to a traffic light support. The method may further comprise coupling an optical light source and a visible light filter to the laser emitting diode. The method may further comprise configuring the visible light filter to be remotely activated such that only infrared radiation is emitted by the infrared laser emitter when the visible light filter is active.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. §112, ¶6. Thus, the use of the words "function," "means" or "step" in the Description, Drawings, or Claims is not intended to somehow indicate a desire to invoke the special provisions of 35 U.S.C. §112, ¶6, to define the invention. To the contrary, if the provisions of 35 U.S.C. §112, ¶6 are sought to be invoked to define the claimed disclosure, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112, ¶6. Moreover, even if the provisions of 35 U.S.C. §112, ¶6 are invoked to define the claimed disclosure, it is intended that the disclosure not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended traffic preemption system and/or assembly procedures for a traffic preemption system will become apparent for use with particular implementations from this disclosure. Accordingly, for example, although particular implementations are disclosed, such implementations and implementing components may comprise any shape, size, style, type, model, version, measurement, concentration, material, quantity, and/or the like as is known in the art for such traffic preemption systems and implementing components, consistent with the intended operation.

Figure 1:
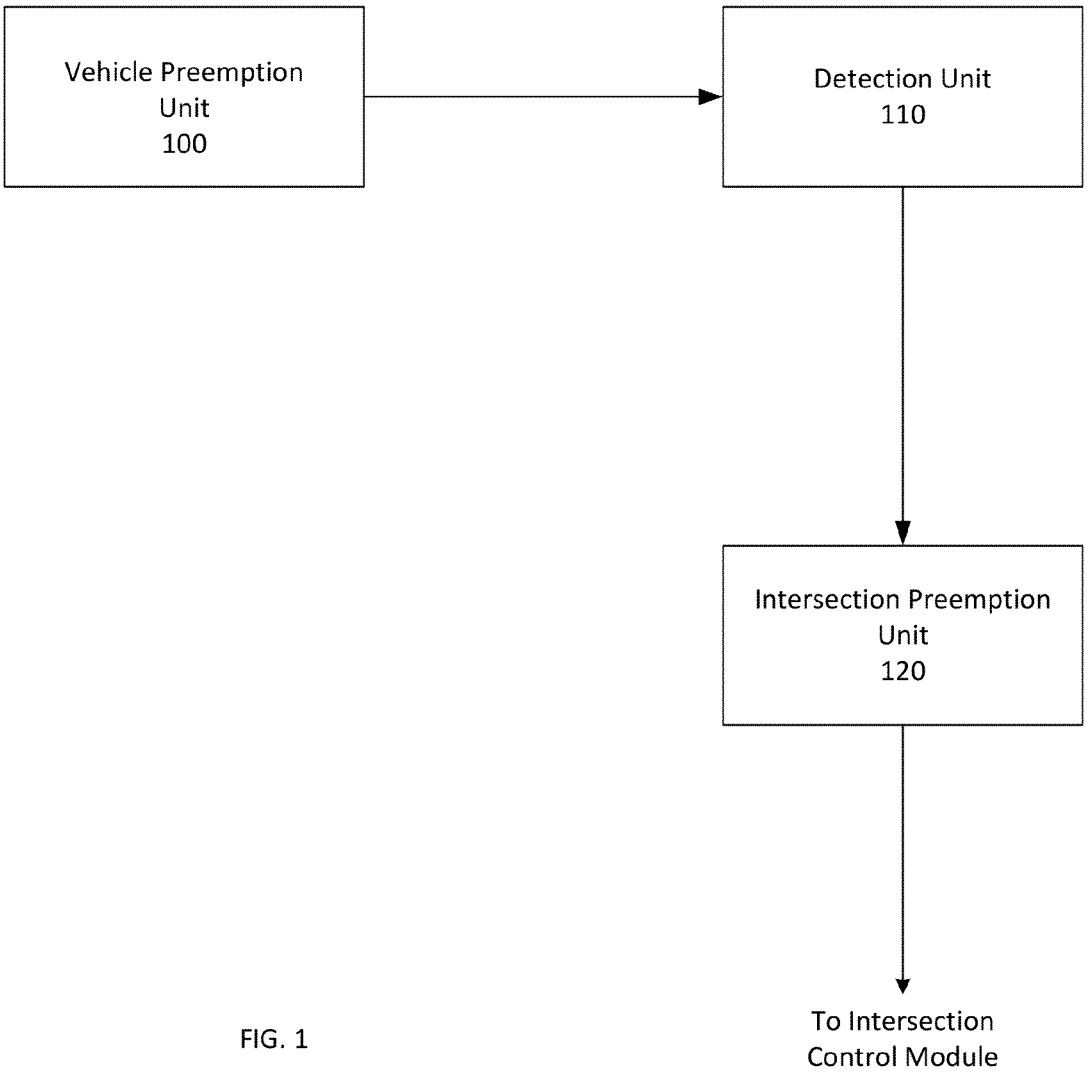
FIG. 1 is a block diagram of an implementation of a traffic preemption system.

Referring to FIG. 1, a block diagram of the basic components of an implementation of a traffic preemption system is illustrated. As shown, the system 100 comprises a vehicle preemption unit 100 which is configured to be mounted to a vehicle. The vehicle may be any vehicle designed for terrestrial, aero, or aquatic travel, and in particular implementations may more commonly comprise an emergency vehicle, such as, but not limited to a police car, fire engine, ambulance, or a high priority non-emergency vehicle, such as a city transit vehicle or a dignitary vehicle. The vehicle preemption unit 100 is designed with one or more signal emitters configured to emit a preemption signal that may be detected by a detection unit 110 located at a traffic intersection. The one or more signal emitters may emit a radio frequency (RF), optical, infrared, or other electromagnetic signal. The detection unit 110 then communicates with an intersection preemption unit 120 which transmits a signal to the intersection control module that ultimately sends a control signal to the traffic light and/or related equipment to change the traffic signal at an appropriately determined time.

Figure 2:
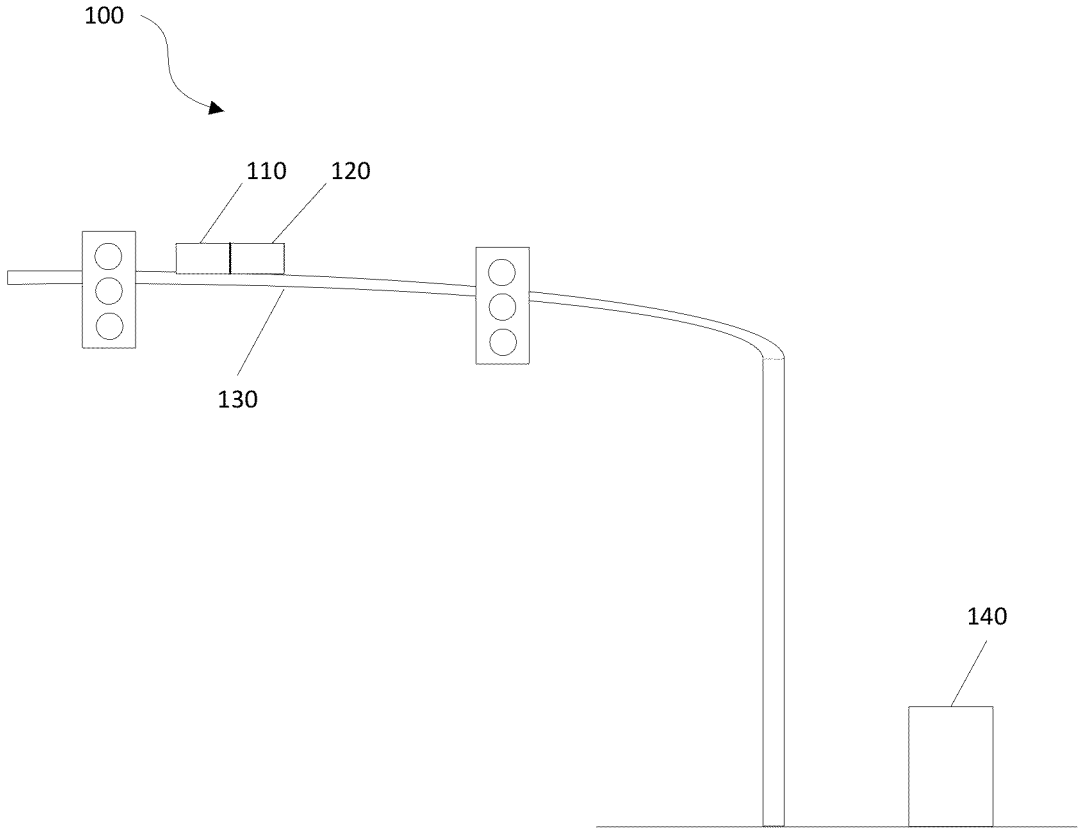
FIG. 2 shows an implementation of a traffic preemption system located at a traffic intersection.

FIG. 2 depicts an implementation of a traffic preemption system as commonly located at a traffic intersection. As shown, the intersection preemption unit 120 may also comprise the detection unit 110 in some implementations and in other implementations, these two components 110, 120 may be discrete components located separately on traffic light support 130 or alternatively, the intersection preemption unit 120 is commonly located within the cabinet of intersection control module 140. The intersection preemption unit 120 is configured to provide power and communicate with the intersection control module 140 as well as other electronic devices that may also comprise the traffic preemption system. Detection unit 110 is configured to receive radio, optical, infrared, or other signals transmitted from a vehicle preemption unit mounted to an emergency or other vehicle and communicate with intersection preemption unit 120.

Figure 3:
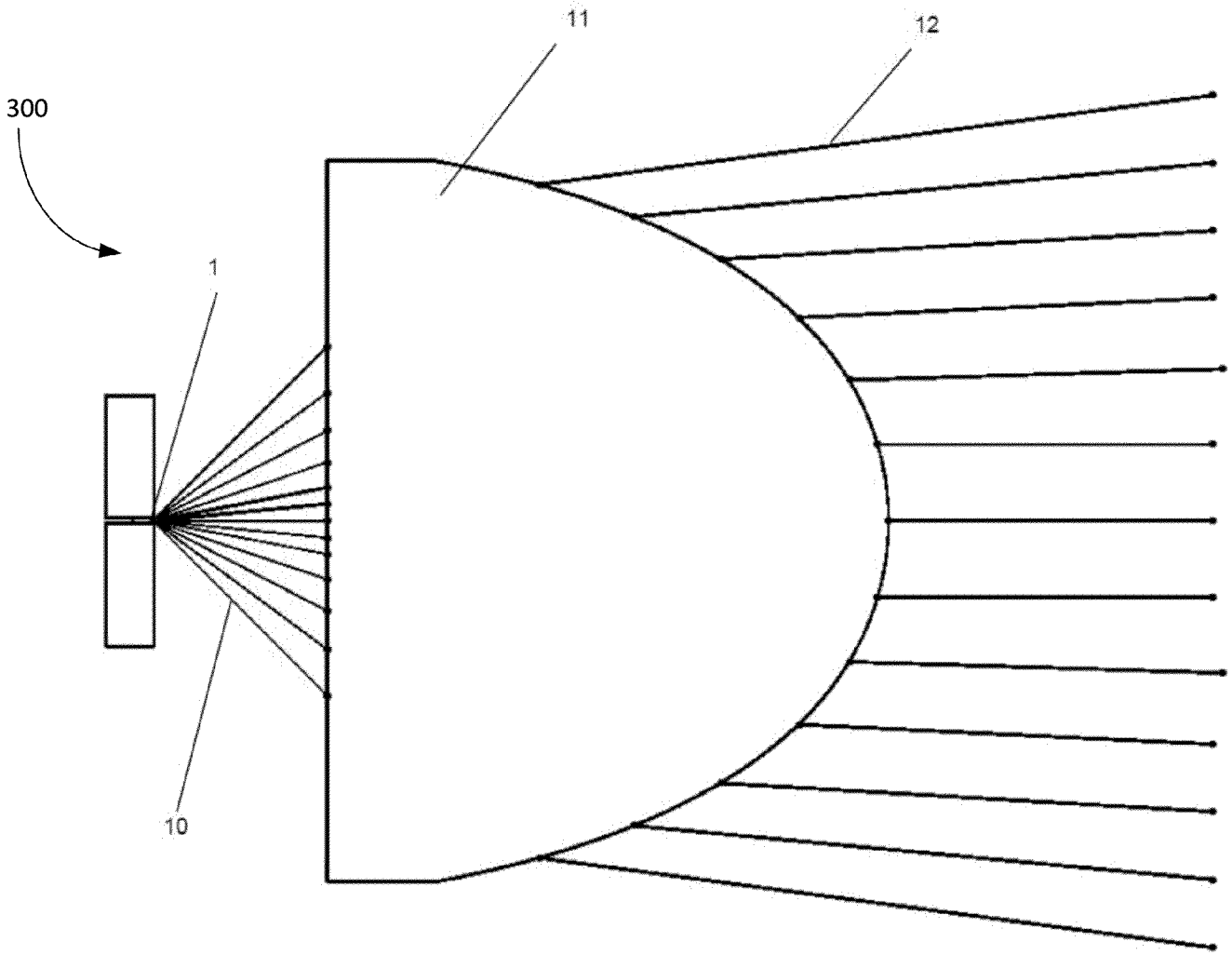
FIG. 3 is a representation of an implementation of a laser emitter for use in a traffic preemption system.

FIG. 3 shows an example of an implementation of a laser emitter 300 for use in a traffic preemption system in which one or more laser emitting diodes 1 emit a signal 10 which passes through an optic 11 that shapes the original signal 10 into a shaped signal 12 having a beam width that is different than that of the original signal 10 emitted by the one or more laser emitting diodes 1. This shaping of the laser beam allows the signal to be more readily detected by detection units. One or more laser emitting diodes 1 may emit in a visible, infrared, or any other appropriate frequency range. The optic 11 may be comprised of any material or shape that results in the desired beam width of the shaped signal 12 and in some implementations may have an aspheric shape.

Figure 4:
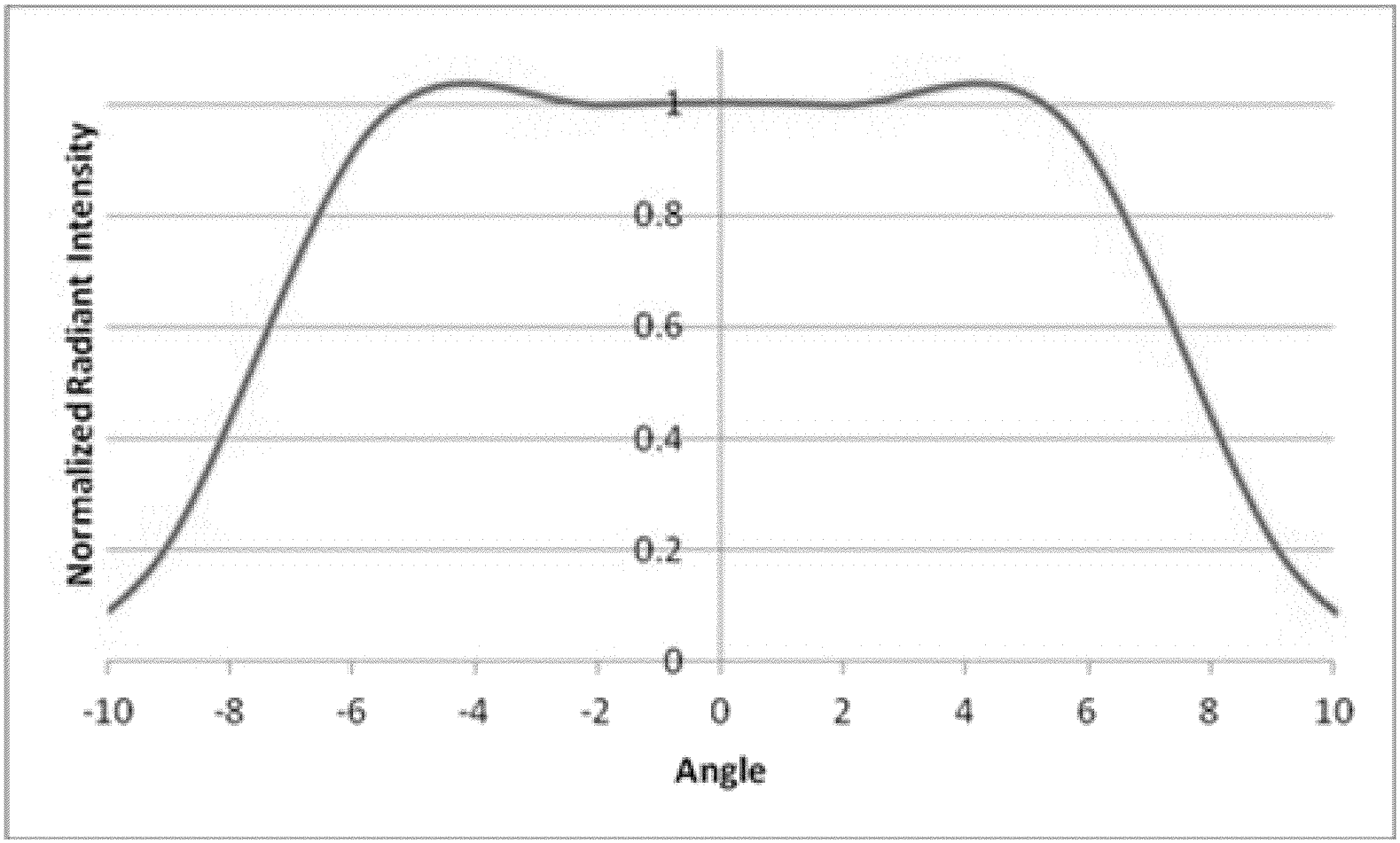
FIG. 4 is a graph of normalized radiant intensity versus angle for an implementation of a laser emitter for use in a traffic preemption system.

As shown in FIG. 4, the optic may be used to shape the laser signal such that a graph of the intensity of the laser output may have a substantially flattened intensity over the desired angular range, rather than Gaussian, shape in one axis. By varying the type of optic used or the shape or the material comprising the optic, the range of angles over which the intensity curve is flattened may be varied.

Figure 5:
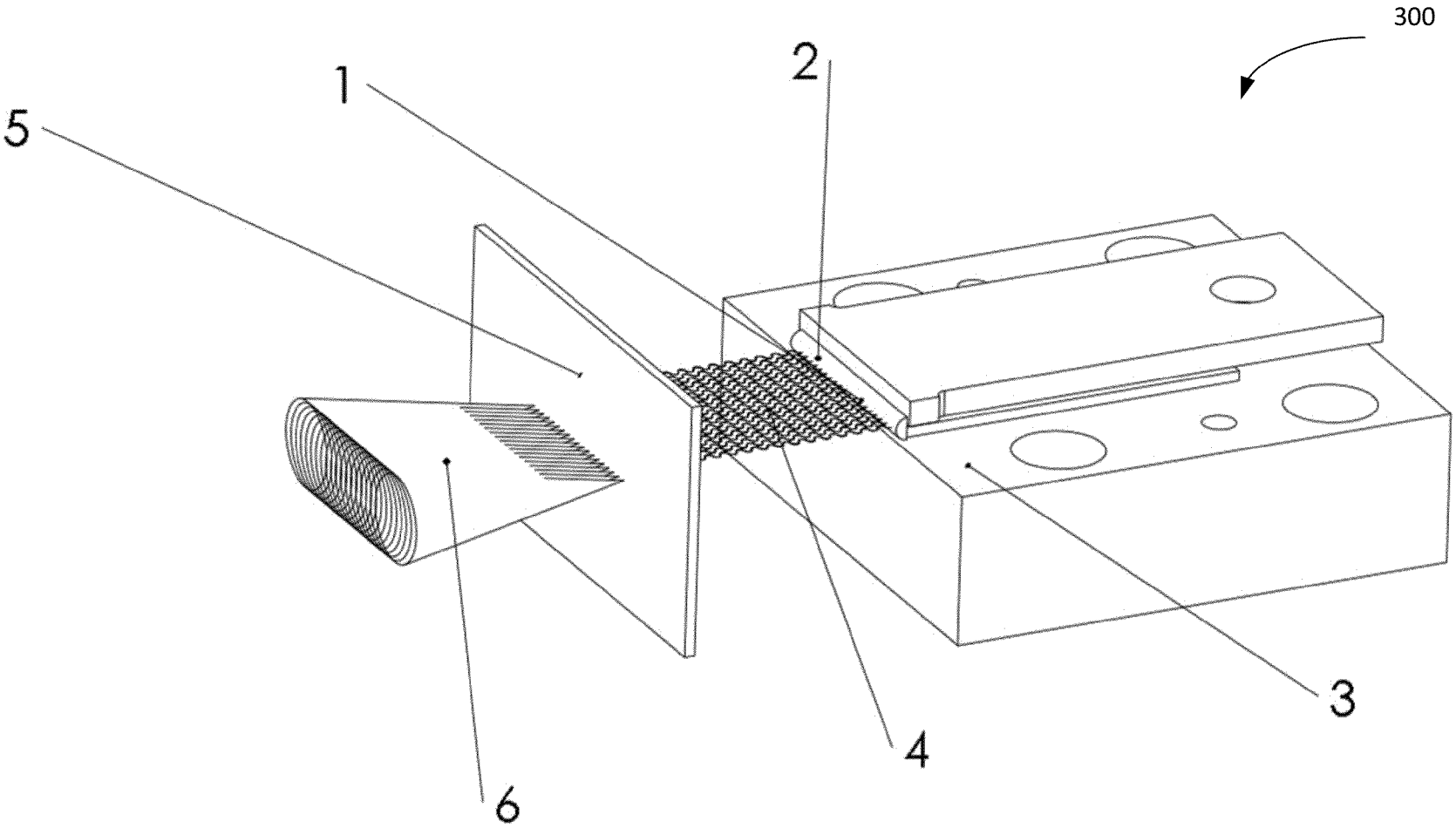
FIG. 5 shows an alternative embodiment of an implementation of a laser emitter for use in a traffic preemption system.

FIG. 5 provides a depiction of an alternative implementation of a laser emitter 300 which may be a component of a vehicle preemption unit for use in a traffic preemption system. In some embodiments, a single or plurality of laser emitting diodes 1 may be arranged in an array or other format that allows the signal emitted by the diode(s) 1 to be transmitted to a detection unit. Additionally, some implementations may further comprise a heat sink 3 to provide conductive cooling of the thermal energy produced. The use of laser emitting diodes 1 provides an advantage over conventional emitters that use light emitting diodes (LED's) due to fact that collimating the signal emitted by the laser diodes results in a much narrower collimation thereby eliminating the need for large and cumbersome collimating optics. However, the major advantage of the laser diode array is the amount of energy available in a small source size to provide range. Typically, only an approximate beam width of +/−5 degrees is needed for proper detection of the signal by a detection unit and as such, the use of laser emitting diodes may result in a smaller and more compact vehicle preemption unit.

As shown here, some implementations utilize a collimating lens 2 to focus and narrow the laser beam emitted from the one or more diodes 1. After passing through the collimating lens 2, the quasi-collimated beam 4 may be too narrow to effectively trigger detection by a detection unit. Accordingly, the quasi-collimated beam 4 may then pass through one or more diffusing optics 5 to spread the laser beam to create a beam width of the emitted signal 6 that is likely to be recognized by a detection unit, for example a beam width of +/− 5 degrees. The one or more diffusing optics 5 may be comprised of, for example, one or more holographic, binary, ground glass, or directional optics. Additionally, one of ordinary skill in the art would recognize that any such appropriate optic may be used that results in an appropriate beam width of the emitted laser preemption signal 6.

The use of laser emitting diodes also offers the advantages of a higher power output than that of conventional infrared LED's as well as more stability in output signal characteristics over changes in temperature. For purposes of this disclosure, it is contemplated that any wavelength of laser emitting diodes may be used, however, in some implementations, it may be advantageous to utilize an array of laser emitting diodes having a wavelength of approximately 880 nm.

The emitted preemption signal 6 may comprise a pulse or series of pulses occurring at a predetermined frequency and for a predetermined duration, the timing and length of which are used to convey to the detection unit various items of information regarding the vehicle to which the preemption unit is mounted, it's intended path, or a priority status of the vehicle. Some implementations may further comprise one or more infrared LED's which results in a wider emitted signal and flexibility regarding the output signal angle. The use of infrared LED's and/or optical LED's may also provide more options for conveying information to the detection unit. For example, infrared or optical LED's may have a pulse pattern that is different from that of the laser emitting diodes and therefore, may convey different information. Additionally, a vehicle preemption unit equipped with both laser or other infrared and visible preemption signal emission capabilities may utilize both infrared and visible preemption signal emission when the vehicle driver wishes to alert surrounding traffic to its presence or the system may be operated only in its infrared emission mode which allows the vehicle to preempt traffic without a visual signal. For example, an emergency vehicle traveling to an emergency may choose to use both infrared and visible preemption signal emission whereas, when the vehicle is leaving the emergency scene and simply desires to return to the station as quickly as possible, by using only the laser preemption signal emitter, traffic is not alerted to the fact that preemption is occurring.

In some implementations, vehicle priority status may be indicated by a predetermined pattern in the emitted laser or LED signal. For example, a vehicle traveling to an emergency scene may have a higher priority than when the vehicle is moving away from the scene and accordingly, the signal pattern emitted by the vehicle preemption unit may be adjusted based on this change in priority. This change in priority may be a result of a manual adjustment to the priority information contained in the signal pulse pattern or it may occur automatically based on an adjustment of one or more other parameters such as the vehicle's location, route of travel, operation of visible preemption signals, etc. The laser emitter may also be configured to emit pulses in accordance with a code or other predetermined signaling pattern that may be used to indicate the type or manufacturer of the laser emitter.

In some implementations, the laser emitter may further comprise one or more safety features intended to decrease safety risks inherent in emitting a laser signal. For example, a safety shutoff circuit may be implemented to terminate power to the laser emitter or otherwise prevent laser emission in the event of a system malfunction. To deter people from looking directly at the laser beam for an extended period of time, one or more bright visible LED or other optical emitting devices may be placed in close proximity to the point of laser emission, thereby minimizing optical injury to those in the path of the laser beam. Alternatively, this risk of optical injury may also be addressed by implementing a receiver into the laser emitter that is configured to detect a weak infrared or other pulse that is first emitted and if an object or human is within a predetermined proximity to the laser emitter, the weak infrared or other pulse is reflected back to the receiver which then prevents any higher powered laser pulses from being emitted until such an obstruction is removed from the path of emission.

In some embodiments in which the vehicle preemption unit has both a laser emitter such as for example, an infrared emitter, and a visible light emitter, such as for example, a strobe light, implementations of the system may further comprise a visible light filter. The visible light filter may be activated manually or remotely such as from inside the vehicle. When the visible light filter is not active, both visible and infrared signals are emitted by the vehicle preemption unit and may be detected by the detection unit. However, when the visible light filer is activated, only the infrared signal will pass through the filter as the visible light will be blocked by the filter. This prevents the need to turn the visible light emitter off and on as the visible light filter may be employed when a visible preemption signal is not desired. One of ordinary skill in the art would recognize that this visible light filter may be either a mechanical or electronic filter.

Figure 6:
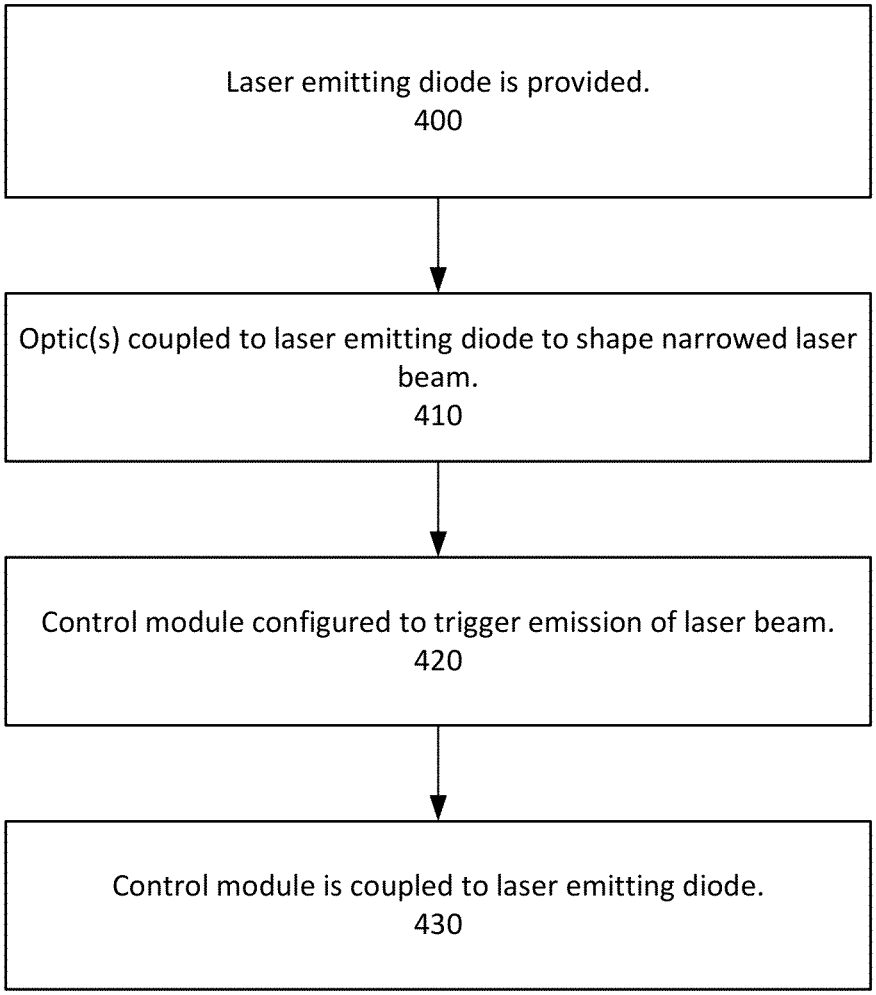
FIGS. 6-7 are block diagrams of implementations of a method of creating a laser emitter for use in a traffic preemption system.

Additionally, FIG. 6 provides a block diagram of an implementation of a method of laser traffic control preemption in which a laser emitting diode is provided 400 and coupled to one or more optics to shape the laser beam when the beam passes through the one or more optics 410. A control module is then configured to trigger emission of the laser beam at a predetermined frequency and for a predetermined duration in compliance with one or more requirements of the traffic control preemption system 420, such as for example, emitting a laser beam having a predetermined pulse pattern used to convey information such as the vehicle's location, priority status, or any other pertinent information. This configured control module may then be coupled to the laser emitting diode such that an implementation of such a laser emitter is formed 430.

Figure 7:
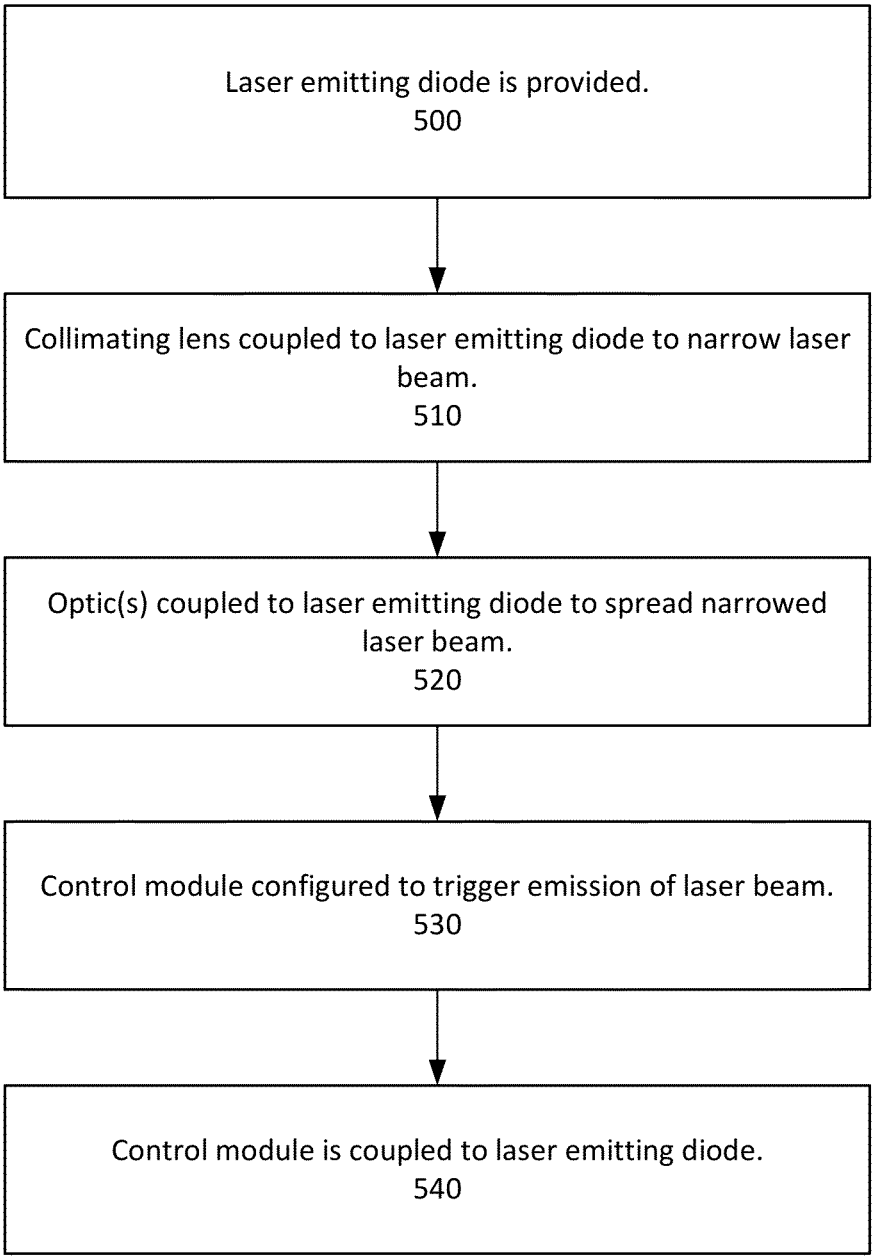

FIG. 7 provides as block diagram of an alternative implementation of a method of laser traffic preemption in which one or more laser emitting diodes is provided 500 and coupled to collimating lens in order to narrow the laser beam emitted by the one or more laser emitting diodes 510. One or more optics, such as for example, a beam shaping diffuser, is then coupled to the laser emitting diode to spread the narrowed laser beam when the beam passes through the one or more optics 520. A control module is then configured to trigger emission of the laser beam at a predetermined frequency and for a predetermined duration in compliance with one or more requirements of the traffic control preemption system 530, such as for example, emitting a laser beam having a predetermined pulse pattern used to convey information such as the vehicle's location, priority status, or any other pertinent information. This configured control module may then be coupled to the one or more laser emitting diodes such that an implementation of such an infrared laser emitter is formed 540.

In places where the description above refers to particular implementations of traffic preemption systems, it should be readily apparent that a number of modifications may be made without departing from the spirit thereof and that these implementations may be applied to other traffic preemption systems.

The invention claimed is:

1. A laser emitter for a traffic control preemption system, the laser emitter comprising:

a laser emitting diode configured to emit a laser beam to a traffic control preemption system detection unit;

one or more optics coupled to the laser emitting diode and configured to shape the laser beam;

a collimating lens configured to narrow the laser beam when the laser beam passes through the collimating lens prior to passing through the one or more optics; and a control module configured to trigger emission of the laser beam at a predetermined frequency and for a predetermined duration in accordance with one or more requirements of the traffic control preemption system.

2. The laser emitter of claim 1, wherein the one or more optics is a beam shaping diffuser.

3. The laser emitter of claim 1, wherein the one or more optics is configured to spread the laser beam to a width that is recognized by the traffic control preemption system.

4. The laser emitter of claim 1, wherein the laser emitter is configured to mount to a vehicle.

5. The laser emitter of claim 1, wherein the laser emitting diode is configured to emit an infrared radiation.

6. The laser emitter of claim 5, further comprising:

an optical light source; and a visible light filter.

7. The laser emitter of claim 6, wherein the visible light filter is configured to be remotely activated such that only infrared radiation is emitted by the laser emitter when the visible light filter is active.

8. The laser emitter of claim 1, further comprising one or more light emitting diodes (LED's) configured to increase a range of angles or intensity at which a beam is emitted from the laser emitter.

9. The laser emitter of claim 1, further comprising one or more light emitting diodes (LED's) wherein the control module is further configured to trigger the one or more LED's to emit light according to a flash pattern that is different than that of the laser emitting diode.

10. The laser emitter of claim 9, wherein the control module is further configured to activate the one or more LED's independently of activation of the laser emitting diode.

11. The laser emitter of claim 1, wherein the control module is further configured to trigger emission of the laser beam according to a flash code that designates a level of priority when received by a traffic control preemption unit configured to mount to a traffic light support.

12. The laser emitter of claim 1, wherein the laser beam comprises a beam width of +/− 5 degrees when emitted.

13. A method of creating a laser emitter for traffic control preemption, the method comprising:

providing a laser emitting diode configured to emit a laser beam to a traffic control preemption system detection unit;

coupling one or more optics to the laser emitting diode such that the one or more optics are configured to shape the laser beam;

coupling a collimating lens between the laser emitting diode and the one or more optics such that the laser beam is narrowed when the laser beam passes through the collimating lens prior to passing through the one or more optics;

configuring a control module to trigger emission of the laser beam at a predetermined frequency and for a predetermined duration in accordance with one or more requirements of a traffic control preemption system; and coupling the control module to the laser emitting diode.

14. The method of claim 13, wherein the one or more optics is a beam shaping diffuser.

15. The method of claim 13, further comprising configuring the one or more optics to spread the laser beam to a width that is recognized by the traffic control preemption system.

16. The method of claim 13, further comprising configuring the laser emitter to mount to a vehicle.

17. The method of claim 13, wherein the laser emitting diode is configured to emit infrared radiation.

18. The method of claim 17, further comprising coupling an optical light source and a visible light filter to the laser emitting diode.

19. The method of claim 18, further comprising configuring the visible light filter to be remotely activated such that only infrared radiation is emitted by the infrared laser emitter when the visible light filter is active.

20. The method of claim 13 further comprising configuring one or more light emitting diodes (LED's) to increase a range of angles or intensity at which a beam is emitted from the laser emitter and coupling the one or more LED's to the laser emitting diode.

21. The method of claim 13, further comprising coupling one or more light emitting diodes (LED's) with the laser emitting diode and further configuring the control module to trigger the one or more LED's to emit light according to a flash pattern that is different than that of the laser emitting diode.

22. The method of claim 21, further comprising configuring the control module to activate the one or more LED's independently of activation of the laser emitting diode.

23. The method of claim 13, further comprising configuring the control module to trigger emission of the laser beam according to a flash code that designates a level of priority when received by a traffic control preemption unit configured to mount to a traffic light support.

24. The method of claim 13, wherein the laser beam comprises a beam width of +/− 5 degrees when emitted.

* * * * *